US011045002B1

(12) United States Patent
Saperton

(10) Patent No.: US 11,045,002 B1
(45) Date of Patent: Jun. 29, 2021

(54) QUICK-RELEASE FOOTREST DEVICE

(71) Applicant: B&Z Productions, LLC, Phoenix, AZ (US)

(72) Inventor: Michael S. Saperton, Phoenix, AZ (US)

(73) Assignee: B&Z Productions, LLC, Phoenix, AZ (US)

( * ) Notice: Subject to any disclaimer, the term of this patent is extended or adjusted under 35 U.S.C. 154(b) by 0 days.

(21) Appl. No.: 16/750,536

(22) Filed: Jan. 23, 2020

Related U.S. Application Data

(60) Provisional application No. 62/796,044, filed on Jan. 23, 2019.

(51) Int. Cl.

| | |
|---|---|
| ***A47C 7/52*** | (2006.01) |
| ***A47C 7/50*** | (2006.01) |
| ***A47C 7/00*** | (2006.01) |
| *A47C 3/30* | (2006.01) |

(52) U.S. Cl.
CPC ..... *A47C 7/5066* (2018.08); *A47C 7/004* (2013.01); *A47C 3/30* (2013.01)

(58) Field of Classification Search
CPC ..... A47C 7/004; A47C 3/30; A47C 7/5066; F16B 2/02; F16B 2/10; F16M 13/02; B25B 5/04
USPC ..... 297/423.19, 423.25, 423.39, 423.4, 297/423.42, 423.44, 423.45; 248/188.7, 248/226.11, 227.3, 230.4, 231.51
See application file for complete search history.

(56) References Cited

U.S. PATENT DOCUMENTS

| | | | | |
|---|---|---|---|---|
| 2,703,691 | A | 3/1955 | Minnis | |
| 3,790,119 | A | 2/1974 | Bauer | |
| 3,820,844 | A * | 6/1974 | Fortnam | A47C 7/52 297/423.37 |
| 3,891,270 | A | 6/1975 | Crossman et al. | |
| 4,283,033 | A | 8/1981 | Bauer | |
| 4,623,195 | A * | 11/1986 | Avella | A47C 7/004 297/423.38 X |
| 4,905,951 | A | 3/1990 | Putness | |
| 4,979,718 | A | 12/1990 | Bauer et al. | |
| 5,476,020 | A | 12/1995 | Garvey et al. | |
| 5,882,076 | A | 3/1999 | Garelick et al. | |
| 6,004,064 | A | 12/1999 | Franz | |
| 6,012,775 | A | 1/2000 | Czarnecki | |
| 6,022,077 | A | 2/2000 | Kirkland et al. | |
| 6,030,037 | A | 2/2000 | Ritch et al. | |

(Continued)

FOREIGN PATENT DOCUMENTS

| | | |
|---|---|---|
| CN | 2412830 | 1/2001 |
| CN | 101549735 A | 10/2009 |

(Continued)

*Primary Examiner* — Rodney B White
(74) *Attorney, Agent, or Firm* — Thomas W. Galvani, P.C.; Thomas W. Galvani

(57) ABSTRACT

A footrest device for supporting feet apart from a cylinder includes a central hub, an outer ring spaced apart from the central hub, and spars, each extending radially from a proximal end, on the first jaw of the hub, to a distal end on the ring. The hub is a clamp with an open condition and a closed condition for clamping onto the cylinder, and it includes first and second jaws pivoted to each other to open and close the hub about a space configured to receive the cylinder. A latch assembly opens and closes the first and second jaws with respect to each other.

17 Claims, 5 Drawing Sheets

(56) References Cited

U.S. PATENT DOCUMENTS

| | | | | |
|---|---|---|---|---|
| 6,082,680 | A | 7/2000 | Woodward et al. | |
| 6,116,183 | A | 9/2000 | Crow et al. | |
| 6,142,571 | A * | 11/2000 | Benden | A47C 7/004 297/423.4 |
| 6,607,246 | B1 * | 8/2003 | Benden | A47C 7/004 297/423.4 |
| 6,695,407 | B1 * | 2/2004 | Lin | A47C 1/02 297/423.38 |
| 6,941,621 | B1 | 9/2005 | Wolforth et al. | |
| 7,451,958 | B2 | 11/2008 | Ritter et al. | |
| 7,452,034 | B2 * | 11/2008 | Jung | A47C 7/506 297/423.4 X |
| 7,938,377 | B2 | 5/2011 | Draghici et al. | |
| 8,052,218 | B2 | 11/2011 | Grove | |
| 8,075,056 | B2 | 12/2011 | Glockl et al. | |
| 8,246,118 | B2 * | 8/2012 | Moore | A47C 7/506 297/423.25 |
| 8,827,216 | B2 * | 9/2014 | Brown | F16M 11/123 248/227.3 X |
| 8,888,184 | B2 | 11/2014 | Meyer et al. | |
| 8,888,398 | B2 * | 11/2014 | Werth | F16M 13/02 248/218.4 |
| 8,979,050 | B2 * | 3/2015 | Yu | A47C 3/28 248/227.3 X |
| 9,578,969 | B1 * | 2/2017 | Su | A47C 7/5064 |
| 9,642,465 | B1 * | 5/2017 | Su | A47C 7/506 |
| 9,706,849 | B2 * | 7/2017 | Su | A47C 7/5064 |
| 10,260,671 | B2 * | 4/2019 | James | A47C 3/30 |
| 10,772,432 | B2 * | 9/2020 | Park | A47C 7/004 |
| 2003/0151291 | A1 * | 8/2003 | Lin et al. | A47C 7/5064 297/423.38 |
| 2006/0043245 | A1 * | 3/2006 | Baker | F16M 13/02 248/227.3 X |
| 2006/0214489 | A1 | 9/2006 | Cheng | |
| 2007/0102979 | A1 | 5/2007 | Tedesco | |
| 2009/0208277 | A1 * | 8/2009 | Werth | F16L 23/08 403/312 |
| 2013/0038109 | A1 | 2/2013 | Chi | |
| 2014/0271036 | A1 | 9/2014 | Emmerich | |
| 2019/0249819 | A1 | 8/2019 | James et al. | |
| 2019/0269248 | A1 * | 9/2019 | Beloff | A47C 7/52 |

FOREIGN PATENT DOCUMENTS

| | | |
|---|---|---|
| GB | 2120088 A | 11/1983 |
| JP | 2895447 B2 | 5/1999 |

* cited by examiner

QUICK-RELEASE FOOTREST DEVICE

CROSS-REFERENCE TO RELATED APPLICATIONS

This application claims the benefit of U.S. Provisional Application No. 62/796,044, filed Jan. 23, 2019, which is hereby incorporated by reference.

FIELD

The present invention relates generally to office furniture, and more particularly to devices for disassembling office furniture quickly and easily.

BACKGROUND

In the exhibitor and conference industry, office furniture is repeatedly transported in trucks, unpacked, set up, used, and then packed back into the trucks for transportation to a warehouse or other storage facility. Some pieces of furniture—conference tables, media screens, speakers, etc.—are fairly easy to pack; they can be laid flat, rolled up, or packed into road cases and then placed into the truck. Items such as these may be densely packed because they are either small or large but heavy.

Some types of furniture, such as office chairs and table tops, present packing issues, however. Table tops generally have to be completely dismantled. Office chairs are relatively light but are quite large and cumbersome. They generally cannot be laid flat, rolled up, or packed into a box. Indeed, most office chairs cannot be disassembled: almost all office chairs have a seat back and a seat bottom mounted on a seat plate. The seat plate connects to a gas-lift or non-gas-lift cylinder that is then mounted in a wheelbase. Moreover, tall draft chairs have footrest rings or split rings mounted on the gas-lift cylinder.

At least one invention, disclosed in U.S. Pat. No. 10,260,671 entitled Gas Cylinder Quick Release Device, describes devices for separating the gas cylinder from the seat bottom and from the wheelbase. Gas cylinders typically have an external sleeve and a rod which reciprocates in the sleeve. The rod is usually directed upward while the sleeve is downward, such that the rod is press fit into the seat plate and the sleeve is press fit into the wheelbase. A fastened socket in the seat plate receives the rod, and a socket—generally a circular hole—in the wheelbase receives the sleeve. When the chair is assembled in this fashion and a user sits in the chair, the rod and sleeve further press into the seat plate and the wheelbase, setting the gas cylinder securely. Over just a few hours, the gas cylinder is driven into a firm and very secure press-fit engagement with the seat plate and the wheelbase. Over days, months, and years, the gas cylinder becomes nearly permanently seated into the seat plate and the wheelbase. When such chairs are transported and stored, the device disclosed in U.S. patent application Ser. No. 15/715,334 allows the chair to be broken apart for better shipping, despite the very tight press-fit engagement between the gas cylinder and the wheelbase.

On some drafting or office chairs, the footrest rings are generally applied to the gas cylinder before the seat plate and the wheelbase are mounted to the gas cylinder and are then secured with a set screw about an inner compression sleeve. As such, they cannot be removed at all. These create a bulky obstacle to the compact packing and shipping of such draft chairs. A way to decouple or remove the footrest ring is needed.

SUMMARY

A footrest device supports feet apart from a cylinder and includes a central hub, an outer ring spaced apart from the central hub, and spars, each extending radially from a proximal end, on the first jaw of the hub, to a distal end on the ring. The hub is a clamp with an open condition and a closed condition for clamping onto the cylinder, and it includes first and second jaws pivoted to each other to open and close the hub about a space configured to receive the cylinder. A latch assembly opens and closes the first and second jaws with respect to each other.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
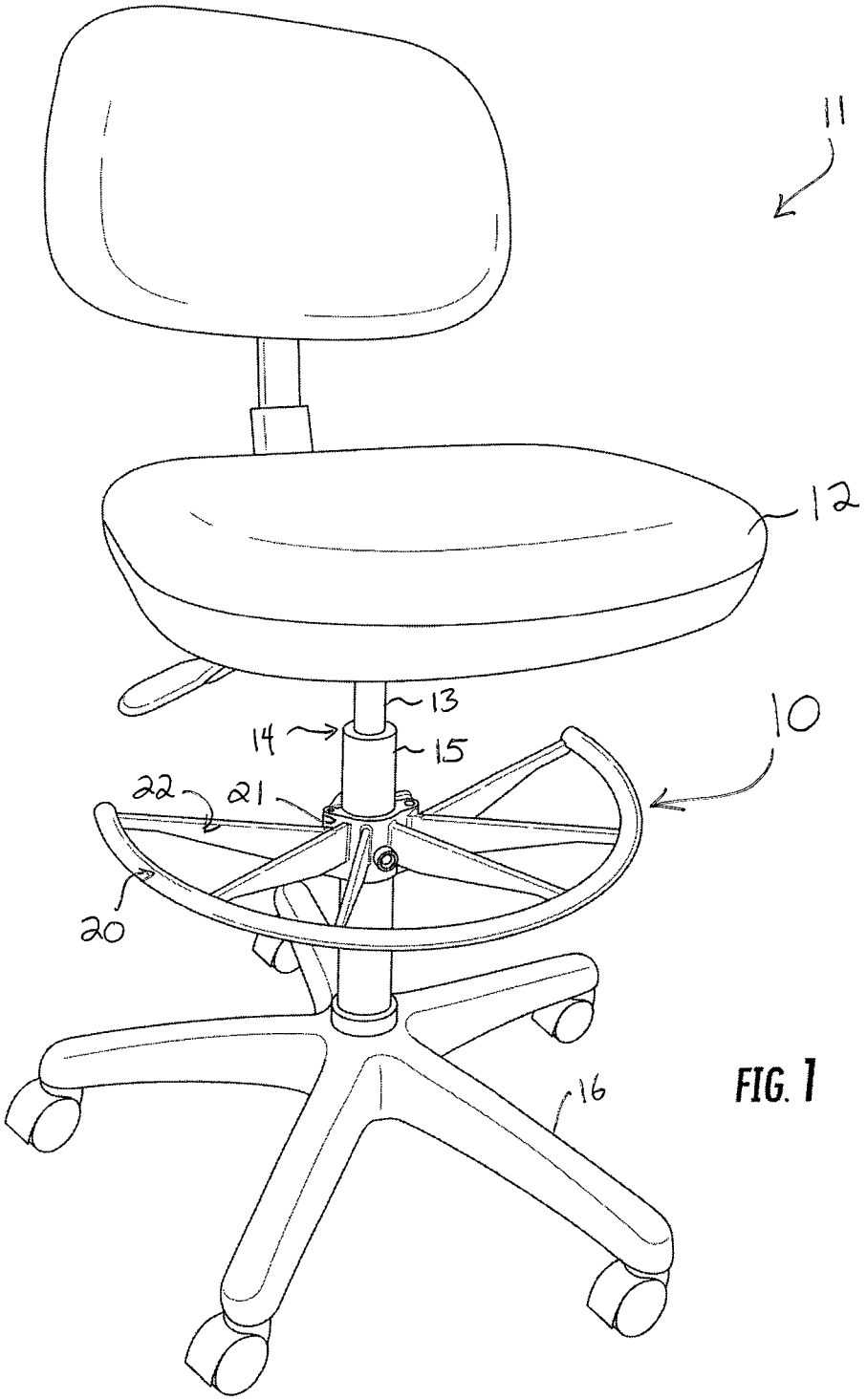
FIG. 1 is a front perspective view of a chair having a gas cylinder and a quick-release footrest device applied thereto.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

FIG. 1 is a perspective view of a chair 11 including a seat back on a seat bottom 12, mounted to a rod 13 of a gas cylinder 14. The rod 13 is within the sleeve 15 of the gas cylinder 14, and the bottom of the sleeve is press-fit into a wheelbase 16. A footrest device 10 is secured on the sleeve 15 and extends out to provide support for the feet of someone sitting on the seat bottom 12. The device 10 includes an outer ring 20, a central hub 21, a plurality of structural spars 22 extending from the hub 21 to the ring 20, and a latch assembly 23 for opening and closing the hub on the gas cylinder 14. The ring 20 defines a footrest where the user of the chair 11 can rest his or feet apart from the gas cylinder 14.

The ring 20 is constructed of a material or combination of materials having strong, rigid, durable, and rugged material characteristics, such as aluminum, steel, a like metal, carbon fiber, or other similar material. The ring 20 shown in these drawings extends along a more-than-semi-circular arc around the hub 21 of approximately two hundred twenty degrees. In other embodiments, the ring 20 is a quarter-circle, a semicircle, a full circle, or some other portion of a circle, and the embodiment shown in these drawings is not meant to be limiting.

Figure 2:
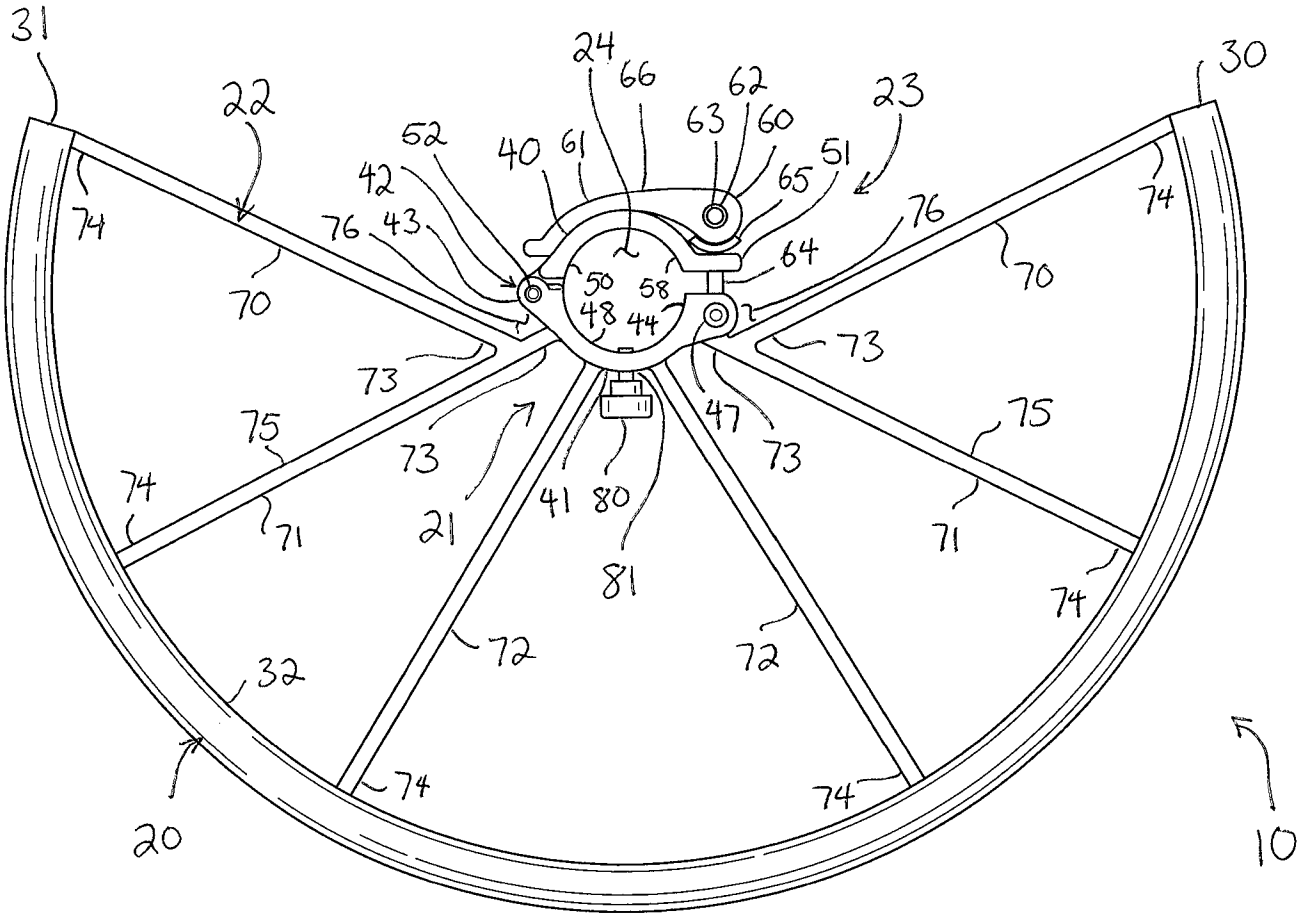
FIG. 2 is a top plan view of the footrest device.

The ring 20 preferably, though not necessarily, has a round or even circular cross-section, as shown in the drawings. Other embodiments of the ring 20, however, have other cross-sections, such as square, rectangular, triangular, etc. The ring 20 is preferably solid. As shown in FIG. 2, the ring 20 has two opposed ends 30 and 31 and an inner surface 32 directed inward toward the hub 21. Although the ring 20 is round and thus has no defined inner face, the inner surface 32 is generally that hemi-cylindrical portion of the ring 20 which is oriented toward the hub 21. In other embodiments of the ring 20 in which the cross-section is another shape, such as square or rectangular, the inner surface 32 is the face directed toward the hub 21.

Referring primarily to FIG. 2, the hub 21 is a clamp having opposed first and second jaws 40 and 41, useful for clamping onto the gas cylinder 14. The jaws 40 and 41 are pivoted to each other at a hinge 42 to move the jaw 40 between a closed position and an open position relative the jaw 41, corresponding to a closed condition and an open condition of the hub 21. In the closed position of the jaw 40—and thus the closed condition of the hub 21—the hub 20 bounds and defines an interior space 24 which is configured to tightly receive the gas cylinder 14. A quick-release latch assembly 23 is pivoted to the jaw 41 to releasably couple, close, and tighten the jaw 41 with respect to the jaw 40, so as to arrange the hub 21 between the unlocked and locked conditions.

Figure 4:
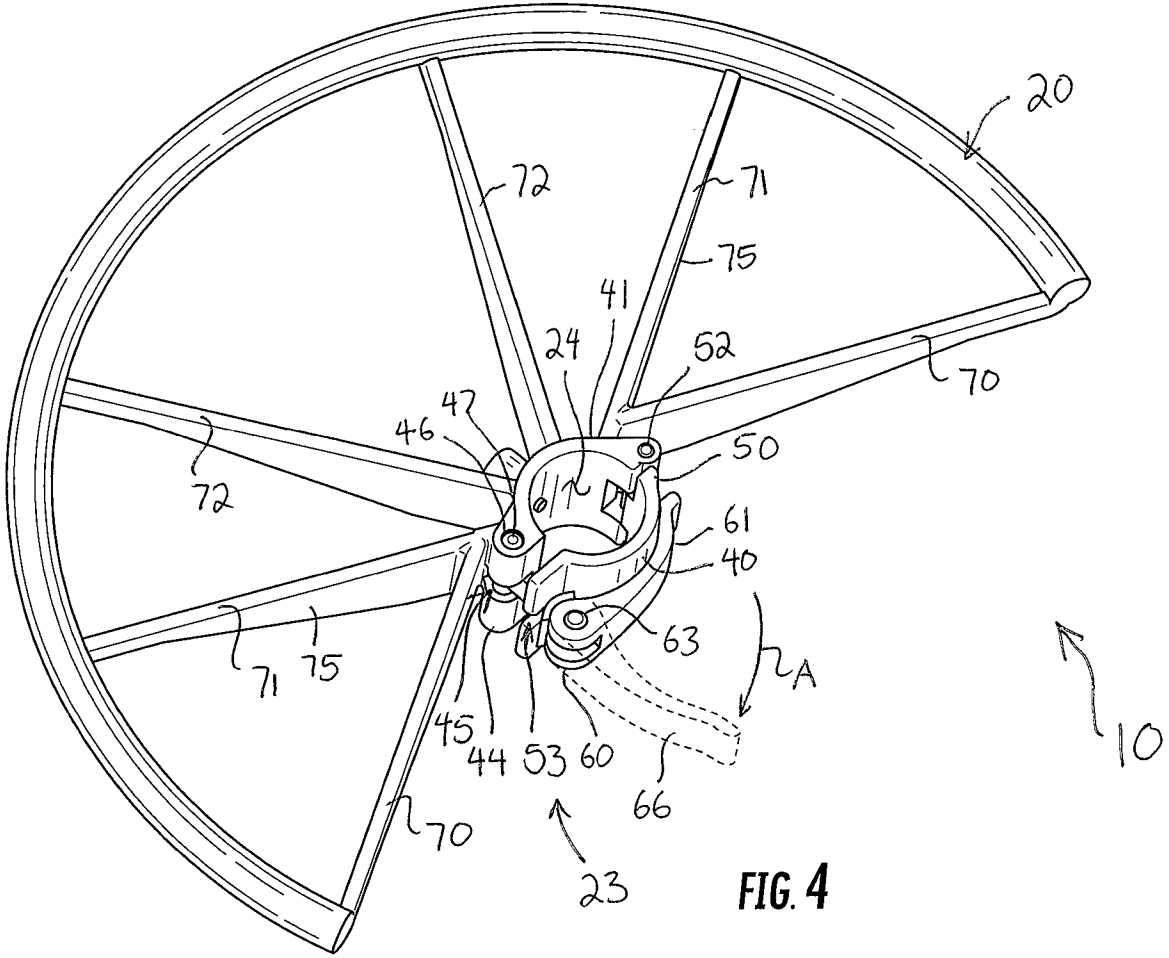
FIGS. 4 and 5 are top perspective views of the footrest device arranged in closed and open conditions, respectively.

The jaw 41 has a roughly semi-cylindrical sidewall with opposed ends 43 and 44. The end 43 is a knuckle forming a portion of the hinge 42. As best shown in FIG. 4, the end 44 is forked, having a medial slot 45 extending longitudinally into the jaw 41, and including a bore 46 for receiving a pin 47. The bore 46 extends through the forked end 44 of the jaw 41 to form two bores or sleeves that hold the pin 47. The quick-release latch assembly 23 is pivoted in this slot 45, as is described in greater detail below.

The jaw 41 includes an inner surface 48, which is arcuate and defines an inner diameter of the jaw 41. The inner diameter of the jaw 41 is just slightly less than the outer diameter of the sleeve 15 of the gas cylinder 14. As such, when the hub 21 is fit onto the gas cylinder 14, the outer diameter of the sleeve 15 is tightly received in contact against the inner surface 48 of the jaw 41.

The jaw 40 is pivoted to the jaw 41. The jaw 40 has opposed ends 50 and 51. The end 50 is a knuckle forming the portion of the hinge 42 complemental to the knuckled end 44 of the jaw 41, and the end 51 is a free end. A pin 52 is passed through bores formed through the ends 43 and 50 to bind the knuckled ends 43 and 50 of the jaws 41 and 40 to each other and form the hinge 42. The jaw 40 has a roughly semi-cylindrical sidewall extending from the end 50 to the end 51. The end 51 is forked, having a medial slot 53 extending longitudinally into the jaw 40. The slot 53 receives a latch of the latch assembly 23 to close the jaw 40 to the jaw 41. The slot 53 severs the free end 52 into opposed upper and lower tangs 54 and 55 (as marked in FIG. 5). The jaw 40 includes an inner surface 58, which is arcuate and defines an inner diameter of the jaw 40. The inner diameter of the jaw 40 is just slightly less than the outer diameter of the sleeve 15 of the gas cylinder 14. As such, when the hub 21 is fit onto the gas cylinder 14, the outer diameter of the sleeve 15 is tightly received in contact against the inner surface 58 of the jaw 40. Further, when the jaw 40 is in the closed position thereof, the tangs 52 and 53 rest against or are brought close to the end 43 of the jaw 41.

Figure 3:
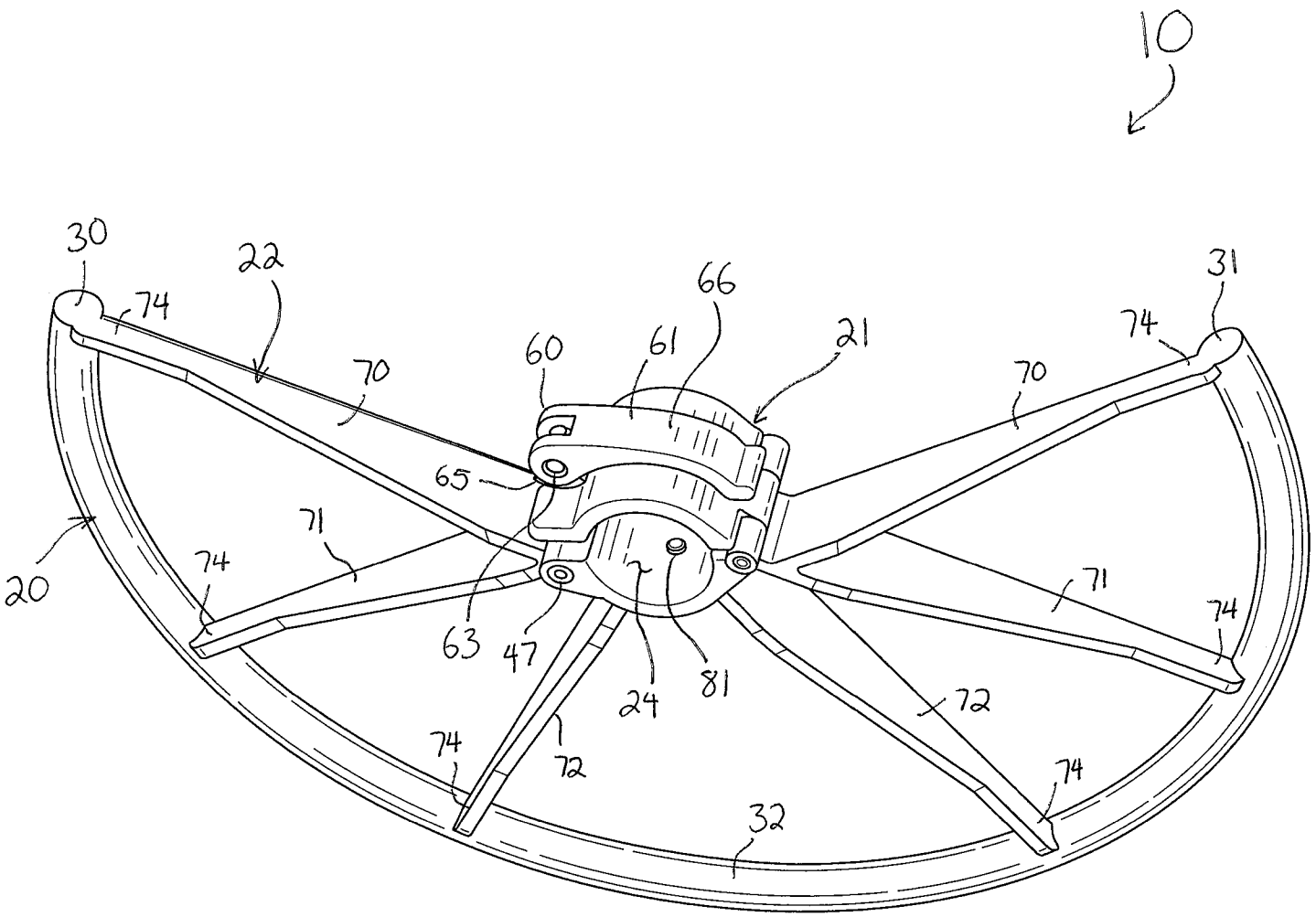
FIG. 3 is a rear perspective view of the footrest device.

Referring to FIGS. 2 and 3, the quick-release latch assembly 23 is coupled to the end 44 of the jaw 41. The quick-release latch assembly 23 includes a cam 60 and a handle 61 formed integrally and monolithically to the cam 60, but extending away from the cam 60. The cam 60 and handle 61 together define a latch 66 of the latch assembly 23. The cam 60 is formed with a bore 62 extending entirely through the cam transverse to the handle 61. The bore 62 holds a pin 63, about which the cam 60 and handle 61 are mounted for rotation. The bore 62 is eccentrically disposed in the cam 60; that is, the bore 62 is offset with respect to the geometric center of the cam 60.

The pin 63 is at the end of a rod 64. The pin 63 is mounted on the rod 64 with a threaded engagement. The pin 63 can be rotated in one direction or another to thread the pin 63 more or less onto the rod 64 and thereby translate the pin 63 down or up the rod 64 slightly, so as to change the effective length of the rod 64 slightly. With the pin 63 mounted on the rod 64, the cam 60 and handle 61 pivot with respect to the rod 64 through a wide range of movement. The pin 47 is at the opposing end of the rod 64. That pin 47 is carried within the bore 46 in the jaw 41; as such, the rod 64 pivots with respect to the jaw 41. This allows the rod 64 to move into and out of the slot 53 defined between the tangs 54 and 55 of the free end 51 of the jaw 40.

Also carried on the rod 64 is a bushing 65. The bushing 65 is below the cam 60 and has a concave shape, such that it mates against the convex outer surface of the cam 60. The bushing 65 is preferably constructed of a plastic such as nylon, but can be constructed of any material presenting a low friction surface in confrontation with the outer surface of the cam 60. As mentioned above, the cam 60 is an eccentric: as the handle 61 is rotated about the pin 63, the cam presents 60 a lesser or greater wall thickness along the direction of the rod 64. In other words, as the handle 61 rotates, the bushing 65 is moved slightly closer to or further from the pin 63, shortening an effective length of the rod 64 with which the jaw 40 can be captured. The bushing 65 is are interposed between the cam 60 of the handle 61 and the upper and lower tangs 54 and 55 of the jaw 40. When the jaw 40 is in the closed position, the rod 64 is passed through the slot 54 between those tangs 54 and 55.

The ring 20 is supported by the spars 22 connected to the hub 21. The spars 22 space the ring 20 apart from the hub 20, far apart: the ring 20 is spaced apart from the hub 20 by approximately four times the inner diameter of the jaw 41. The ring 20 supports the feet of the person sitting in the chair, and so to support this cantilevered weight with respect to the hub 21, the spars 22 are all constructed from a material or combination of materials having strong, rigid, durable, and rugged material characteristics, such as aluminum, steel, a like metal, carbon fiber, or other similar material. Turning to FIGS. 2 and 3, six spars 22 are shown. In other embodiments of the device 10, a greater or lesser number of spars 22 may be used. The spars 22 are different: there are two outer spars 70, two inner spars 71, and two central spars 72.

The outer spars 70 extend generally radially from the hub 20 to the ring 20 proximate the ends 30 and 31. The inner spars 71 are adjacent to and set in from the outer spars 70. The central spars 72 are adjacent to and set in from the inner spars 71, and the central spars 72 are adjacent each other as well.

Each of these spars 70-72 has a proximal end 73 and an opposed distal end 74. And the distal end 74 of every spar 70-72 is formed to the inner surface 32 of the ring 20 so as to permanently fix the spars 70-72 to the ring 20. The proximal ends 73 of the inner and central spars 71 and 72 are formed to the outer surface of the jaw 41 of the hub 21. The proximal ends 73 of the outer spars 70 are formed to the inner spars 71 to permanently fix the spars 70 to the inner spars 71. The proximal end 73 of each outer spar 70 is formed on the spar 71 itself, proximate to the hub 20 but not on the hub 20. There is a slight gap along the inner spar 71 between the jaw 41 and the proximal end 73 of the outer spar 70.

Moreover, the outer spar 70 is formed to an outer face 75 of the inner spar 71, directed toward the outer spar 70. By setting the proximal end 73 of the outer spar 70 slightly away from the jaw 41 on the outer face 75 of the inner space 71, the outer spar 70 creates circumferential gaps 76 between the outer spars 70 and the hub 20. This provides room for the jaw 40 and latch assembly 23 to pivot and swing open, such that the hub 21 can be removed from the gas cylinder 14 more easily.

In operation, the hub 21 is useful to securely position, couple, and secure the footrest device 10 on the sleeve 15. The hub 21 can be opened to remove the footrest device 10 from the sleeve 15 when the chair 11 is ready to be packed up and transported. FIG. 1 illustrates the device 10 in a closed condition on the sleeve 15. The following discussion describing how to remove the footrest device 10 is made with respect to FIGS. 4 and 5, which show the device 10 separate from the gas cylinder 14, but one having ordinary skill in the art will still understand the description without the presence of the gas cylinder 14 in the drawings.

When the hub 20 is in the closed condition, the handle 61 is in the closed position, as shown in solid line in FIG. 4. The handle 61 is directed against the hub 20, along the outer surface of the jaw 40. In this position of the handle 61, the cam 60 pushes the bushing 65 toward the end 44 of the jaw 41. Because the jaw 41 is relatively fixed, and because the jaw 40 pivots with respect to the jaw 41 about the hinge 42, placing the handle 61 into the closed position moves the jaw 40 toward the jaw 41. Again, this is because the cam 60 is an eccentric: as the handle 61 is moved into the closed position, the cam 60 rotates to present a greater wall thickness along the direction of the rod 64. This shortens the effective length of the rod 64, that is, the length of the rod 64 from the end 44 of the jaw 41 onto which the free end 51 of the jaw 40 can be fit. This draws the jaw 40 closer to the jaw 41, thereby constricting the hub 21 about the sleeve 15. Because the jaws 40 and 41 have inner diameters just slightly less than the outer diameter of the sleeve 15 of the gas cylinder, this clamps the hub 20 tightly onto the sleeve 15.

As further security, a set screw 80 is set through a bore 81 in the jaw 41. Referring briefly to FIG. 2, the bore 81 is formed transversely through the sidewall of the jaw 41 and is threaded. The set screw 80 is complementally threaded, and is applied to and tightened within the bore 81 to extend through the bore 81. The set screw 80 is tightened until its end contacts and presses against the sleeve 15 of the gas cylinder 14, thereby preventing movement of the device 10 with respect to the gas cylinder 14.

To remove the footrest device 10 from the gas cylinder 14, the set screw 80 is withdrawn from engagement with the cylinder 14. Then, the handle 61 is taken up, such as by hand, and moved away from the jaw 40, along the pivotal direction of the arcuate arrowed line A in FIG. 4, into the position shown in that drawing in broken line. Pivoting the handle 61 about the pin 63 at the end of the rod 64 allows the bushing 65 to move slightly apart from the tangs 54 and 55 of the end 51 of the jaw 40. This, in turn, allows the ends 51 and 44 of the jaws 40 and 41 to move apart from each other as well. This loosens the jaws 40 and 41 with respect to the sleeve 15. The handle 61 is moved until it is at least aligned with the rod 64, as in FIG. 4. At this position of the handle 61, the bushing 65 is sufficiently apart from the tangs 54 and 55 that the rod 64 can be pivoted out of the slot 53 between the tangs 54 and 55.

Figure 5:
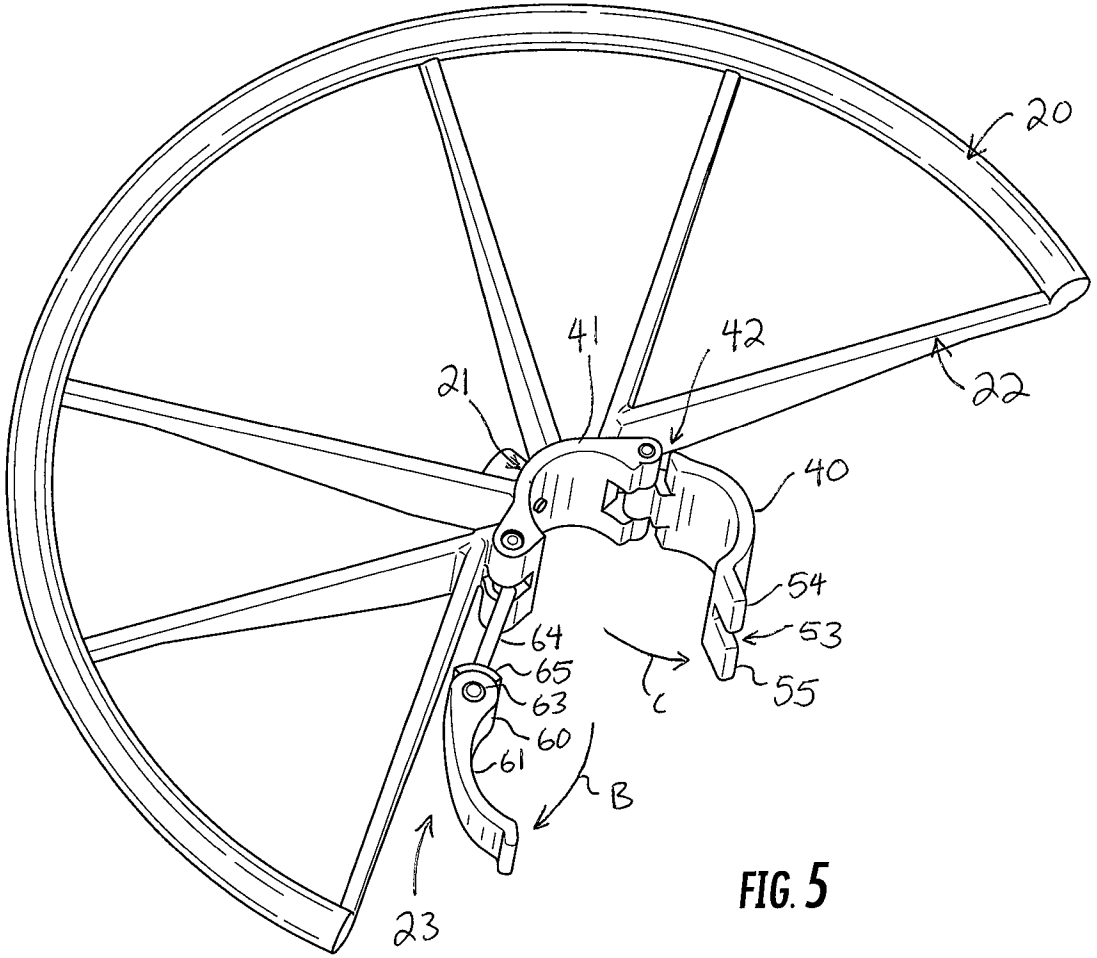

Next, the rod 64 is slipped out of the slot 53 between the upper and lower tangs 54 and 55 by pulling the handle 61 away from the jaw 41, as shown by the arcuate arrowed line B in FIG. 5. This decouples the jaw 40 from the jaw 41. Then, the jaw 40 can be swung out, pivoted about the hinge 42 along the arcuate arrowed line C in FIG. 5. The jaw 40 is swung out sufficiently so that it clears the sleeve 15. Finally, the entire footrest device 10 can be pulled away from the sleeve 15. Though the gas cylinder 14 is not shown in the drawings, one having ordinary skill will readily appreciate how the gas cylinder 14 can be separated from the opened hub 20 in FIG. 5. The footrest device 10 is now entirely decoupled, and the gas cylinder 14 can be decoupled from the seat and/or wheelbase 16 for storage.

The pieces of the chair 11 may then be packed and stored or shipped. When the chair 11 is to be re-assembled on site, the steps above are merely reversed. The footrest device 10 is brought close to the sleeve 15 with the jaw 40 in the open position thereof. When the jaw 41 is registered against the sleeve 15, the jaw 40 is closed around the sleeve 15. The latch assembly 33 is then pivoted, bringing the handle 61 over the end 51 of the jaw 40 and the rod 64 through the slot 53 between the tangs 54 and 55. When the rod 64 is fully received in the slot 53, the handle 61 is moved to the closed position thereof, against the outside of the jaw 40. This tightens the hub 21 about the sleeve 15. If the hub 21 is too tight or not sufficiently tight, the handle 61 can be opened and spun; this causes the pin 63 to threaded in or out on the rod 64 and will change the tightness of the hub 21 on the sleeve 15.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A footrest device for supporting feet apart from a cylinder, the device comprising:

a central hub, the hub including first and second jaws pivoted to each other to open and close the hub about a space configured to receive the cylinder;

an outer ring spaced apart from the central hub; and spars, each extending radially from a proximal end, on the first jaw of the hub, to a distal end on the ring;

wherein the spars include an outer spar, an inner spar fixed to the ring and to the hub, and the outer spar is fixed to the ring and to the inner spar proximate the hub; and wherein the hub is a clamp with an open condition and a closed condition for clamping onto the cylinder.

2. The footrest device of claim 1, further comprising a latch assembly that opens and closes the first and second jaws with respect to each other.

3. The footrest device of claim 2, wherein the latch assembly is pivoted to the second jaw, such that the first jaw is pivoted to move away from the second jaw when the latch assembly is pivoted away from first jaw.

4. The footrest device of claim 2, wherein the latch assembly includes:

a rod pivoted to the second jaw;

a cam pivoted on the rod, and a handle projecting from the cam; and a slot in the first jaw to receive the rod when the first and second jaws are closed.

5. A footrest device comprising:

a central hub configured to be carried on a cylinder;

an outer ring for supporting feet apart from the cylinder; and spars, each extending from a proximal end at the hub to a distal end on the ring;

wherein the spars include an outer spar, an inner spar adjacent the outer spar, the proximal end of the inner spar is formed to the hub, and the proximal end of the outer spar is formed to the inner spar; and wherein the hub is a clamp with an open condition and a closed condition for clamping onto the cylinder.

6. The footrest device of claim 5, wherein the spars each extend radially between the hub and the ring.

7. The footrest device of claim 5, wherein the clamp includes:

a semi-cylindrical first jaw;

a semi-cylindrical second jaw; and a latch assembly that releasably opens and closes the first and second jaws with respect to each other.

8. The footrest device of claim 7, wherein the latch assembly is pivoted to the second jaw, such that the first jaw is pivoted to move away from the second jaw when the latch assembly is pivoted away from first jaw.

9. The footrest device of claim 7, wherein the latch assembly includes:

a rod pivoted to the second jaw; and a cam pivoted on the rod, and a handle projecting from the cam; and a slot in the first jaw to receive the rod when the first and second jaws are closed.

10. The footrest device of claim 9, wherein the cam and rod are threadably engaged to translate the cam along the rod.

11. A footrest device, comprising:

a central hub;

an outer ring; and spars extending between the hub and the ring to space the ring apart from the hub;

wherein the spars include an outer spar, an inner spar fixed to the ring and to the hub, and the outer spar is fixed to the ring and to the inner spar proximate the hub; and wherein the hub is a clamp for clamping onto a cylinder.

12. The footrest device of claim 11, wherein the spars extend radially from the hub to the ring.

13. The footrest device of claim 11, wherein the hub comprises:

a semi-cylindrical first jaw; and a semi-cylindrical second jaw to which the first jaw is pivoted.

14. The footrest device of claim 13, further comprising a latch assembly that opens and closes the first and second jaws with respect to each other.

15. The footrest device of claim 14, wherein the latch assembly is pivoted to the second jaw, such that the first jaw is pivoted to move away from the second jaw when the latch assembly is pivoted away from first jaw.

16. The footrest device of claim 14, wherein the latch assembly includes:

a rod pivoted to the second jaw;

a cam pivoted on the rod, and a handle projecting from the cam; and a slot in the first jaw to receive the rod when the first and second jaws are closed.

17. The footrest device of claim 16, wherein the cam and rod are threadably engaged to translate the cam along the rod.

* * * * *